US010870972B2

(12) United States Patent
Czerwinski, Jr. et al.

(10) Patent No.: US 10,870,972 B2
(45) Date of Patent: Dec. 22, 2020

(54) PRESSURE SENSITIVE TOUCH ELECTRONIC FAUCET

(71) Applicant: Spectrum Brands, Inc., Middleton, WI (US)

(72) Inventors: Jerome F. Czerwinski, Jr., Ladera Ranch, CA (US); Chasen Scott Beck, Costa Mesa, CA (US); Stephen Paul Blizzard, Corona, CA (US)

(73) Assignee: Spectrum Brands, Inc., Middleton, WI (US)

( * ) Notice: Subject to any disclaimer, the term of this patent is extended or adjusted under 35 U.S.C. 154(b) by 0 days.

(21) Appl. No.: 15/998,572

(22) PCT Filed: Feb. 3, 2017

(86) PCT No.: PCT/US2017/016416

§ 371 (c)(1),
(2) Date: Aug. 15, 2018

(87) PCT Pub. No.: WO2017/142715

PCT Pub. Date: Aug. 24, 2017

(65) Prior Publication Data

US 2019/0032311 A1 Jan. 31, 2019

Related U.S. Application Data

(60) Provisional application No. 62/295,294, filed on Feb. 15, 2016.

(51) Int. Cl.
*E03C 1/05* (2006.01)
*E03C 1/04* (2006.01)

(52) U.S. Cl.
CPC ..... *E03C 1/055* (2013.01); *E03C 2001/0415* (2013.01); *E03C 2201/50* (2013.01)

(58) Field of Classification Search
CPC ..... E03C 1/055; E03C 2001/0415; E03C 2201/50
See application file for complete search history.

(56) References Cited

U.S. PATENT DOCUMENTS

| | | | | |
|---|---|---|---|---|
| 8,516,628 | B2 * | 8/2013 | Conroy | E03C 1/05 4/559 |
| 9,106,194 | B2 * | 8/2015 | Glebe | H03G 3/02 |
| 2009/0119832 | A1 | 5/2009 | Conroy | |
| 2013/0077804 | A1 | 3/2013 | Glebe et al. | |
| 2013/0141338 | A1 | 6/2013 | Wei et al. | |
| 2013/0248620 | A1 | 9/2013 | Evans et al. | |
| 2013/0340162 | A1 | 12/2013 | Peel | |

* cited by examiner

*Primary Examiner* — Janie M Loeppke
(74) *Attorney, Agent, or Firm* — Merchant & Gould P.C.

(57) ABSTRACT

A faucet having a pressure-sensitive surface for dynamically adjusting the faucet's water flow rate and/or temperature based on an amount of pressure applied to the surface of the faucet is disclosed. A pressure sensor may be electronically connected to one or more electronic valves of the faucet to control the flow of water through either the cold or hot water lines, thereby controlling the flow rate and/or temperature of water coming from the faucet.

17 Claims, 6 Drawing Sheets

PRESSURE SENSITIVE TOUCH ELECTRONIC FAUCET

RELATED APPLICATIONS

This application is a National Stage Application of PCT/US2017/016416, filed Feb. 3, 2017, which claims the benefit of U.S. Provisional Application Ser. No. 62/295,294, for a "Pressure Sensitive Touch Electronic Faucet" filed Feb. 15, 2016, which is applications are incorporated herein by reference. To the extent appropriate, a claim of priority is made to each of the above disclosed applications.

TECHNICAL FIELD

The present disclosure relates to a water faucet, and particularly to a water faucet providing electronic control of the faucet via at least touch operation.

BACKGROUND AND SUMMARY

There are a variety of different types of faucets, including a "widespread" faucet and a single-control faucet. Such faucets typically have multiple characteristic functions and operations, such as on/off, flow control, and temperature control. Most faucet assemblies include a spout mounted atop a countertop, and one or more handles/operating levers adjacent the spout to control the flow and/or temperature of water flowing from the faucet. A typical faucet assembly also includes an underbody located beneath the countertop. A pair of valves (one hot and one cold) is located in the underbody and each valve may be connected to a stem that extends upwardly into the handle(s), which are used to control the valves via the handles and allow water to flow to the spout in a conventional manner. The valves may be coupled to hot and cold water lines, respectively. Alternatively, a single mixing valve threaded into the bottom of the spout may be used to mix hot and cold water through the valve, and a single operating lever atop the spout that is shifted to control the volume of flow as well as the mixing of hot and cold through the valve to set the temperature.

Faucets that include one or more touch sensors at various locations, such as the spout or handle, are known in the art. Typically, a touch sensor permits a user to turn water flow on and off merely by tapping the spout or handle to trigger the sensor, with the sensor being electronically connected to the water line valves in order to open or close the valves. Specifically, a user would touch the spout or handle once to turn on the flow of water, and the user would then touch the spout or handle again to turn off the flow of water. The touch sensor would be able to distinguish between a touch that is a user's tap and a touch that is extended grasping of the spout (e.g. in order to move the spout location). Touch sensors were implemented within faucets to provide an easy and convenient way to turn the water off and on without having to manually operate the handle to control the water valves. However, the functionality of such touch sensors provided for binary operation—either on or off—would not permit dynamic adjustment of the water flow rate and temperature.

Therefore, there is a need for a faucet that can permit control of dynamic adjustment of the water flow rate and/or temperature of water flowing through the faucet in a convenient manner. According to one aspect, this disclosure provides a faucet having a pressure-sensitive surface for dynamically adjusting the faucet's water flow rate and/or temperature based on an amount of pressure applied to the surface. A pressure sensor may be electronically connected to one or more electronic valves of the faucet to control the flow of water through either the cold or hot water lines, thereby controlling the flow rate and/or temperature of water coming from the faucet. For example, the pressure sensor could detect and measure the pressure being applied by the user's touch, and the measurement of pressure (or change in pressure) would be used to determine the desired flow rate amount (or change in flow rate) or the desired temperature (or change in temperature) for the water. The pressure-sensitive surface may be located in any predetermined location associated with the faucet, such as a predetermined surface of the faucet, the faucet's deck plate, faucet spray head, spout tube/body or a surface nearby the faucet, to permit such dynamic control. In some embodiments, multiple pressure sensors could be positioned to separately control the flow rate and temperature, or separately control the hot and cold water lines. An optional visual indicator may be included with the faucet to indicate the desired temperature and/or flow rate that is being requested via the particular pressure being applied by a user's touch. An optional visual indicator may be included with the faucet to indicate the current temperature and/or flow rate.

BRIEF DESCRIPTION OF THE DRAWINGS

The present disclosure will be described hereafter with reference to the attached drawings which are given as non-limiting examples only, in which.

DETAILED DESCRIPTION OF THE DRAWINGS

Figure 1:
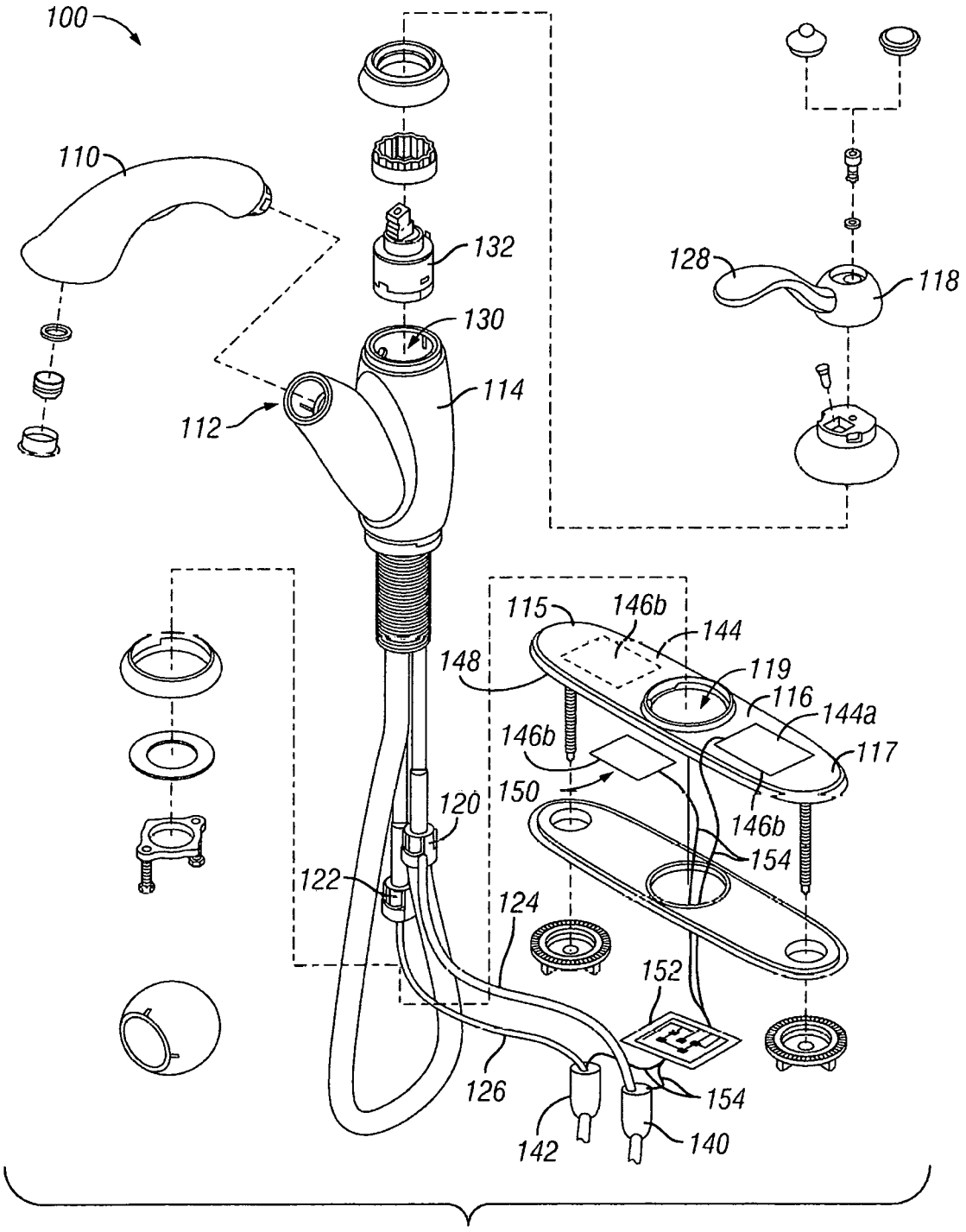
FIG. 1 is an exploded perspective view of an exemplar pressure-sensitive electronic faucet according to one embodiment of the disclosure.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the disclosure.

This disclosure generally relates to an electronic faucet with certain features. The term "electronic faucet" is broadly intended to include any type of faucet assembly that uses electrical power in some manner, including but not limited to electronically controlling water valves, etc. This disclosure encompasses the integration of one or more of the features described herein into any type of electronic faucet, and is not intended to be limited to any particular type of electronic faucet.

FIG. 1 illustrates an electronic faucet 100 according to an embodiment of the disclosure. As illustrated, the faucet 100 includes a spout 110 that is configured to be mounted on a spout dock 112 of a faucet body 114. In the embodiment shown, the faucet body 114 is configured to be mounted on and/or through an optional deck plate 116 that can be mounted on the surface of a sink top or countertop (not shown). In some embodiments, the faucet 100 may not include a deck plate 116, but the faucet body 114 could be directly mounted to an opening in a countertop (not shown). In various embodiments, the faucet body 114 is configured to house a cold water flow connector 120 and a hot water flow connector 122 that are in fluid connection with the spout 110 via a valve cartridge 132. The cold water flow connector 120 is connected to a cold water line 124 and the hot water flow connector 122 is connected to a hot water line 126.

In the embodiment illustrated in FIG. 1, the water flow rate and/or temperature may be controlled manually by a user via operation of a handle 118. In illustrative embodiments, the handle 118 may be comprised of a single operating lever 128 that may be configured to be mounted on a handle aperture 130 of the faucet body 114. In particular, the handle 118 may be mechanically coupled to a valve cartridge 132 positioned within the faucet body 114 that is configured to control flow rate and/or temperature of water based on the position of the operating lever 128. Alternatively, the handle 118 may be comprised of one or more levers (not shown) that are mounted directly on the deck plate 116. In illustrative embodiments, for example, the handle 118 may be comprised of a cold water lever and a hot water lever that are mounted on the deck plate 116 (or the countertop in a configuration without a deck plate), wherein the cold water lever is configured to control the cold water flow and the hot water lever is configured to control the hot water flow. Other variations of controlling the valves 120 and 122 are known in the art. Although the faucet 100 may be manually controlled in some embodiments, other embodiments are contemplated in which the faucet's flow and temperature could be completely electronically controlled.

As illustrated in FIG. 1, flow of water into the spout 110 may alternatively be controlled via an electronic cold water flow valve 140 and an electronic hot water flow valve 142 (or in addition to the manual control). Electronic valves 140 and 142 may be positioned at various locations along cold and hot water lines 124 and 126, respectively. For instance, electronic valves 140 and 142 may be positioned in series with and upstream of the valve cartridge 132 via water lines 124 and 126. Alternatively, electronic valves 140 and 142 may be integrated with, or configured to be used as an alternative to, the valve cartridge 132. Other configurations of electronic valves 140 and 142 are envisioned within the scope of this disclosure.

In illustrative embodiments in accordance with this disclosure, electronic valves 140 and 142 are configured to be operationally controlled via a user's touch on a predetermined surface 144 (also called force element) of the faucet 100 (or a nearby surface associated with the faucet). The force element could be completely detached from the faucet and be remotely electrically coupled (e.g., wire harness, Bluetooth, WiFi, Inductive, Zigbee, Zwave, etc.) back to the faucet. For example, the electronic valves 140 and 142 could be controlled via one or more sensors 146 located below the surface 144 of the faucet 100 and be able to detect when a user touches the surface 144. The sensor 146 may be applied to an interior face 148 of the surface 144 and is configured to detect pressure and/or location of a touch on the outside of the surface 144. In various embodiments, the sensor 146 may be comprised of a pressure-sensing film 150 that extends below the surface 144 or any other force/deflecting sensor (induction, capacitance, piezo electric, etc.). Although the figures show an embodiment with the sensor 146 on the deck plate 116, embodiments are contemplated in which the sensor 146 (and/or touch surface) could be located on the faucet body 114, spout 110, handle 118 or other exterior surface or faucet 100 or other nearby surface.

The one or more sensors 146 are electronically coupled to a circuit board 152 (or similar device) via one or more electronic wires 154 and are configured to transmit information to the circuit board 152 regarding the pressure and/or location of a user's touch. Similarly, the electronic valves 140 and 142 are electronically coupled to the circuit board 152 and are configured to receive information from the circuit board 152 in order to control the operation of the electronic valves 140 and 142. The circuit board 152 is illustratively designed to open the electronic valves 140 and 142 when the sensor 146 sends a signal through the electronic wires 154. In various embodiments, the electronic valves 140 and 142 may be operated by controllers (not shown) that are coupled to the valves 140 and 142. Other means of controlling operation of the electronic valves 140 and 142 are envisioned within the scope of this disclosure.

In illustrative embodiments, the one or more sensors 146 can transmit multiple types of signals to the circuit board 152 to convey different types of touches by a user. For example, the sensor 146 may be able to determine the level of pressure applied by the user's touch and accordingly send a unique signal to the circuit board 152 that indicates the level of pressure being applied. The circuit board 152 may then determine whether to increase or decrease the flow of water through the cold and/or hot water electronic valves 140 and 142 based on the level of pressure identified and send a corresponding signal to the electronic valves 140 and 142 to adjust the electronic valves 140 and 142 accordingly. In such a manner, the flow rate and/or the temperature of the water coming out of the faucet 100 can be dynamically adjusted based on the pressure or location of a user's touch on the surface 144 of the faucet 100.

In one embodiment, an electronic faucet according to the present disclosure employs a pressure-sensing touch detector, which could be a pressure sensing film 150. An example of such a pressure sensing device is manufactured and sold by Microchip Technology, Inc. of Chandler, Ariz. under the name PIC12F1571 which is a microcontroller with capacitive touch channels. An application note describing the implementation can be found on microchip.com. Such technology may include a custom-designed touch button panel and control electronics (e.g., circuits and wiring), with an output interface tailored to the specific needs of a user. Such pressure sensing devices may be advantageous in the present disclosure as it can dynamically sense and react to changes in pressure and location when pressure is applied to a sensor within an electronic faucet.

Figure 2:
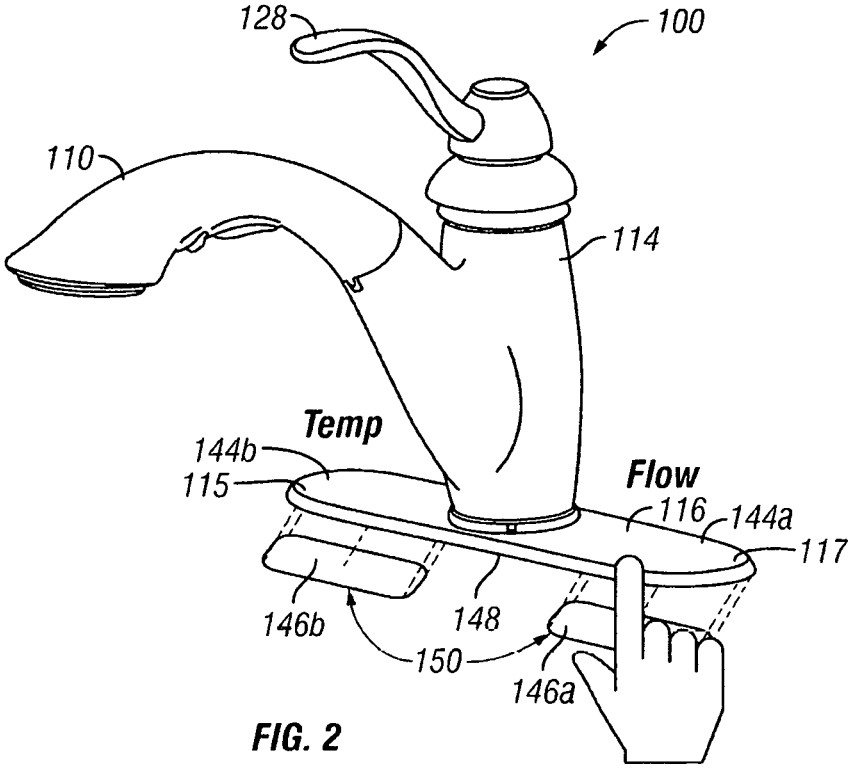
FIG. 2 is a front perspective view of an illustrative embodiment of the electronic faucet according to FIG. 1 illustrating use of a flow-controlling feature of the faucet.
Figure 4:
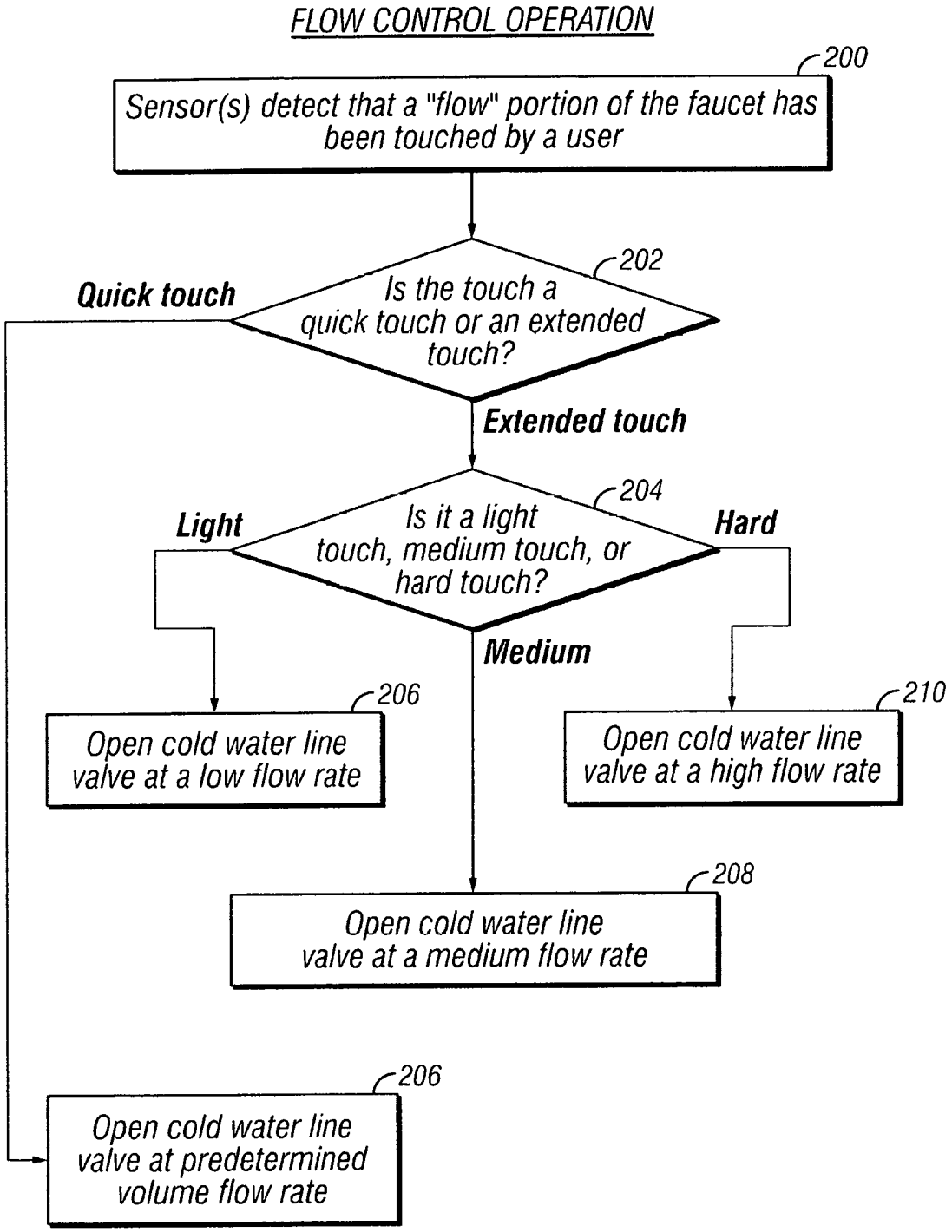
FIG. 4 is a flow chart showing an exemplary flow-rate control operation that may be performed by the electronic faucet according to FIG. 2.

As illustrated in FIGS. 2 and 4, a first embodiment of the electronic faucet 100 of the present disclosure permits a user to adjust at least the rate of flow of water through the faucet 100 via pressure applied by a user's touch. In such an embodiment, a pressure sensor 146 may be located below a surface 144 that is part of the deck plate 116, although other locations of the pressure sensor are envisioned within this disclosure. The deck plate 116 may include a left side 117, a right side 115, and a center aperture 119 positioned between the left side 117 and right side 115 to permit connection of the faucet body 114 to the components below the deck plate 116, such as the water lines 124 and 126. As illustrated in FIG. 2, a first surface 144*a* may be located on the left side 117 of the deck plate 116 and a first sensor 146*a* may extend below the first surface 144*a* on the left side 117. The first sensor 146*a* may be a pressure sensor that is configured to correspond with the flow rate of water through the faucet 100. The first sensor 146*a* is electronically coupled to the circuit board 152 of the electronic faucet 100 in order to transmit information to the circuit board 152 regarding the level of pressure being applied by a user to the first surface 144*a*. The circuit board 152 is electronically coupled to the electronic valves 140 and 142 to operate or control the rate of flow of water through the valves 140 and 142 in response to the information transmitted by the first sensor 146*a*.

FIG. 4 illustrates a flow chart of an exemplary process performed by the electronic faucet 100 to control the flow of water through the faucet 100. While FIG. 4 illustrates a one embodiment of flow rate control, it is envisioned that other methods or processes of flow control can be performed by the pressure-sensing sensors and/or the circuit board of an electronic faucet 100.

As illustrated in FIG. 4, the first step 200 involves a sensor of the faucet detecting that a flow portion of the faucet has been touched by a user. The pressure-sensing sensor 146 (possibly in conjunction with the circuit board 152) identifies whether the touch is a quick touch (e.g. a single tap) or an extended touch as a second step 202. If the touch is a quick touch, then that information is transmitted from the sensor 146 to the circuit board 152, and the circuit board then directs the electronic cold water flow valve 140 to permit flow of cold water at a predetermined or consistent rate of flow, as illustrated in step 206. Alternatively, the circuit board could direct the electronic hot water flow valve 142 to permit flow of hot water at a predetermined or consistent flow rate. Such "quick touch" functionality could be predetermined at a default flow rate and temperature to permit a user to quickly use the faucet 100 without adjusting flow rate or temperature manually.

If the touch is an extended touch, then the sensor 146 (possibly in conjunction with the circuit board 152) would collect additional information regarding the amount of pressure (e.g. light, medium or hard touch) being applied by the user against the surface 144 in a third step 204. The type of pressure/touch being applied is transmitted from the sensor 146 to the circuit board 152, and the circuit board 152 then directs the electronic cold water flow valve 140 to permit flow of cold water at a rate that is dependent on the type of pressure applied. For instance, a light pressure touch could cause the electronic valve 140 to open at a low flow rate as illustrated in step 208, a medium pressure touch could cause the electronic valve 140 to open at a medium flow rate as illustrated in step 210, and a hard pressure touch could cause the electronic valve 140 to open at a high flow rate as illustrated in step 212. Operation of the extended touch feature could alternatively control the flow of water through the electronic hot water flow valve 142. Further, while this illustrative embodiment uses three different types of touch (light, medium and hard) to determine the rate of flow through valves 140 and/or 142, it is envisioned that any number of types of touch may be presented within the scope of the present disclosure. For instance, the sensor 146 may be able to detect and communicate hundreds of different pressure types along a gradient of pressures, and the circuit board 152 may be able to adjust the valves 140 and 142 based on changes from each gradient pressure in order to change the resulting rate of flow of water through the faucet 100.

Figure 3:
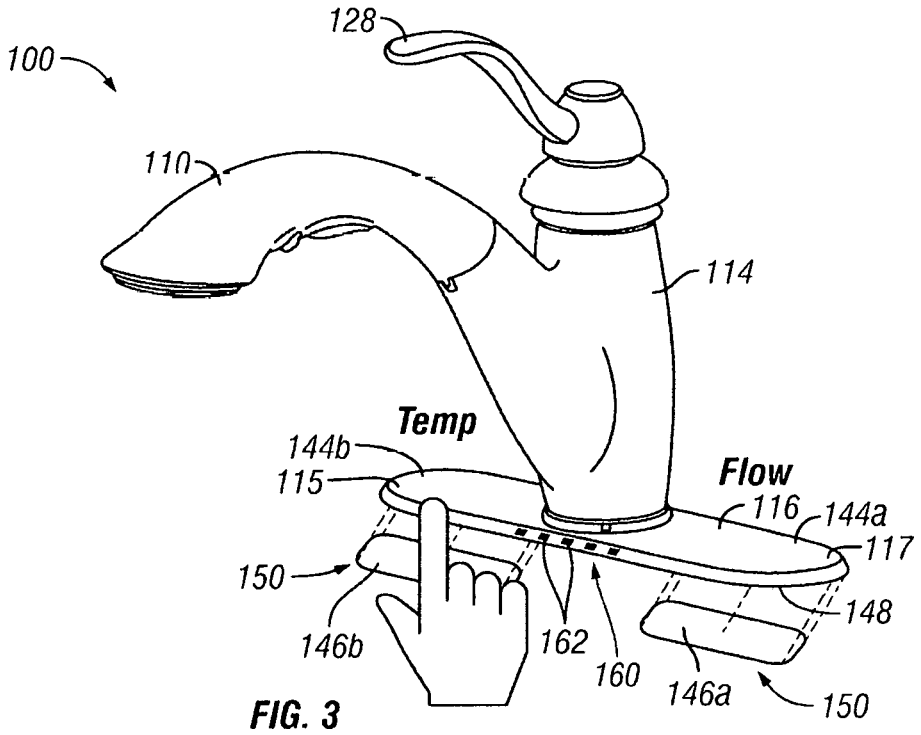
FIG. 3 is a front perspective view of the illustrative embodiments of the electronic faucet as shown in FIG. 2 illustrating use of a temperature-controlling feature of the faucet.
Figure 5:
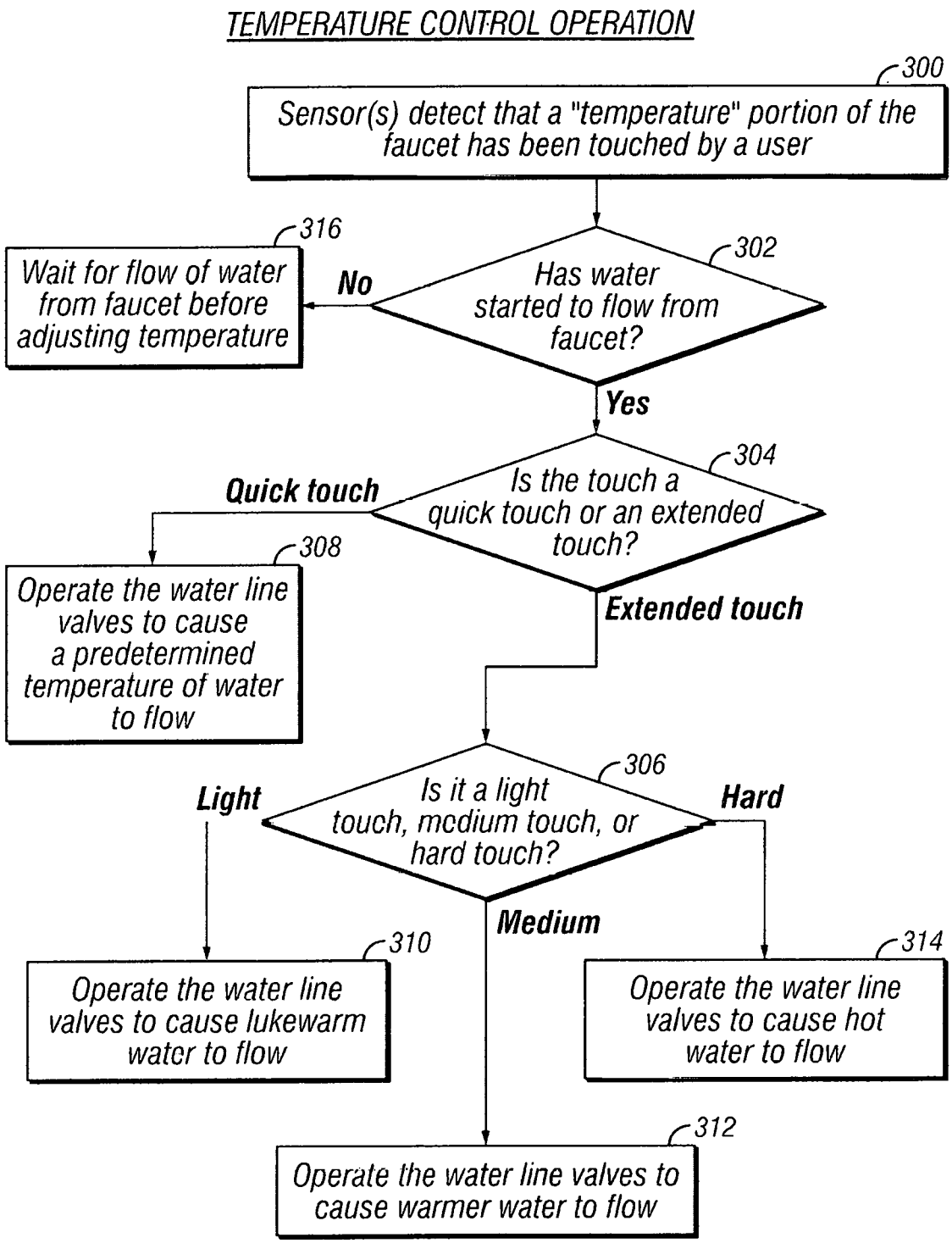
FIG. 5 is a flow chart showing an exemplary temperature control operation that may be performed by the electronic faucet according to FIG. 2.

As illustrated in FIGS. 3 and 5, the first embodiment of the electronic faucet 100 of the present disclosure may optionally further permit a user to adjust the temperature of water flowing through the faucet 100 via pressure applied by a user's touch. In such an embodiment, a pressure sensor is located below the surface 144 that is part of the deck plate 116, although other locations of the pressure sensor are envisioned within this disclosure. As illustrated in FIG. 3, a second surface 144*b* may be located on the right side 115 of the deck plate 116 and a second sensor 146*b* may extend below the second surface 144*b* on the right side 115. The second sensor 146*b* may be a pressure sensor that is configured to correspond with the temperature of water flowing through the faucet 100. The second sensor 146*b* is electronically coupled to the circuit board 152 of the electronic faucet 100 in order to transmit information to the circuit board 152 regarding the level of pressure being applied by a user to the second surface 144*b*. The circuit board 152 is electronically coupled to the electronic valves 140 and 142 to operate or control temperature of water flowing through the faucet by control of the rate of flow of water through the valves 140 and 142 in response to the information transmitted by the second sensor 146*b*.

FIG. 5 illustrates a flow chart of an exemplary process performed by the electronic faucet 100 to control the temperature of water flowing through the faucet 100. While FIG. 5 illustrates one embodiment of temperature control, it is envisioned that other methods or processes of temperature control can be performed by the pressure-sensing sensors and/or the circuit board of an electronic faucet 100.

As illustrated in FIG. 5, the first step 300 involves a sensor of the faucet detecting that a temperature portion of the faucet has been touched by a user. The pressure sensing sensor 146 transmits the information to the circuit board 152, which then determines whether water has started to flow through the faucet 100 in a second step 302 (for instance, by determining whether electronic valves 140 and 142 are open). If water is not flowing through the faucet 100, the circuit board 152 will wait for water to flow through the faucet 100 before taking any action, as illustrated in step 316. If water is flowing through the faucet 100, the pressure-sensing sensor 146 (possibly in conjunction with the circuit board 152) identifies whether the touch is a quick touch (e.g. a single tap) or an extended touch as a third step 304. If the touch is a quick touch, then that information is transmitted from the sensor 146 to the circuit board 152, and the circuit board then directs the flow valves 140 and 142 to permit flow of a predetermined temperature of water at a predetermined or consistent rate of flow, as illustrated in step 308. The rate of flow may be determined, for example, by the current rate of flow occurring in the faucet, and the predetermined temperature may be hot water, cold water, or a mixture of hot and cold water. Such "quick touch" functionality could be predetermined at a default flow rate and temperature to permit a user to quickly use the faucet 100 without adjusting flow rate or temperature manually.

If the touch is an extended touch, then the sensor 146 (possibly in conjunction with the circuit board 152) would collect additional information regarding the amount of pressure (e.g. light, medium or hard touch) being applied by the user against the surface 144 in a fourth step 306. The type of pressure/touch being applied is transmitted from the sensor 146 to the circuit board 152, and the circuit board 152 then controls the water flow valves 140 and 142 to adjust the flow of water to a specific temperature of water that is dependent on the type of pressure applied. For instance, a light pressure touch could cause the valves 140 and 142 to open such that a cold or lukewarm water flows through the faucet as illustrated in step 310, a medium pressure touch could cause the valves 140 and 142 to open such that a warmer water flows through the faucet as illustrated in step 312, and a hard pressure touch could cause the electronic valves 140 and 142 to open such that a hot water flows through the faucet as illustrated in step 314. While this illustrative embodiment uses three different types of touch (light, medium and hard) to determine the temperature of water flowing through valves 140 and 142, it is envisioned that any number of types of touch may be presented within the scope of the present disclosure. For instance, the sensor 146 may be able to detect and communicate hundreds of different pressure types along a gradient of pressures, and the circuit board 152 may be able to adjust the valves 140 and 142 based on changes from each gradient pressure in order to change the resulting temperature of the flow of water through the faucet 100.

Figure 6:
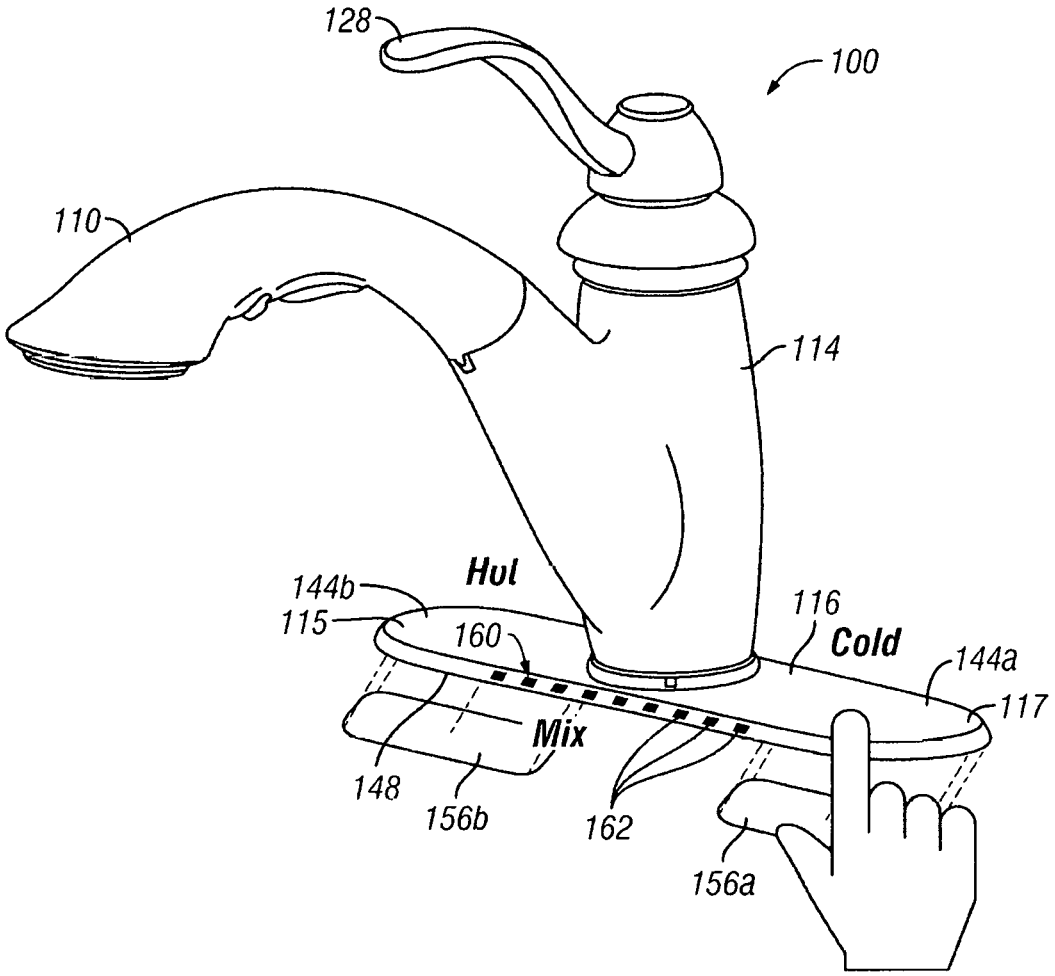
FIG. 6 is a front perspective view of a second illustrative embodiment of the electronic faucet according to FIG. 1, illustrating temperature and/or flow-controlling features of the faucet.
Figure 7:
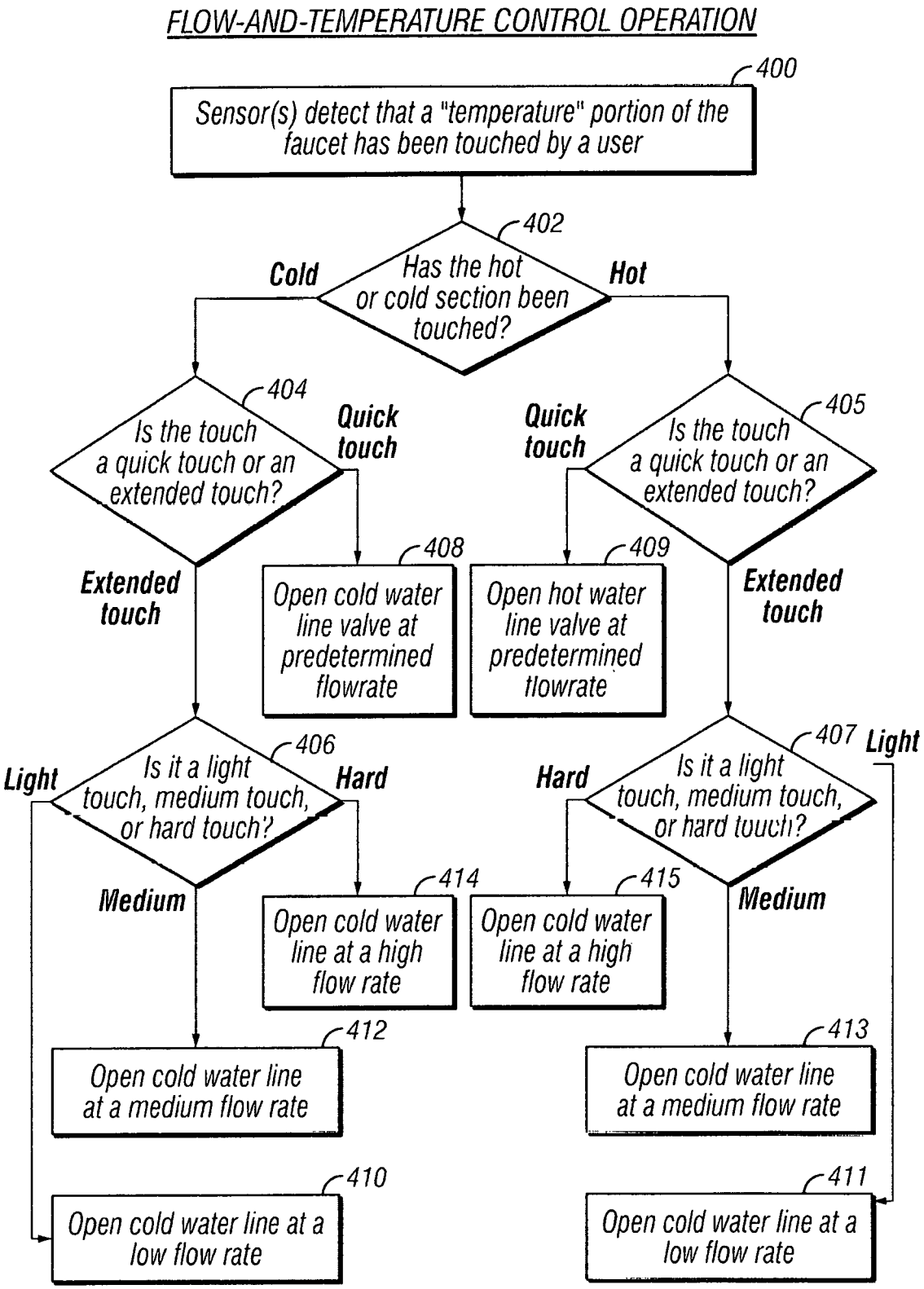
FIG. 7 is a flow chart showing an exemplary temperature and flow-rate control operation that may be performed by the electronic faucet according to FIG. 6.

Another embodiment of the electronic faucet 100 of the present disclosure is illustrated in FIGS. 6 and 7. In this embodiment, the electronic faucet 100 permits a user to adjust the temperature and flow rate of the water flowing in the faucet via pressure applied by a user's touch, but does so in a different manner than the previous embodiment. In this embodiment, as illustrated in FIG. 6, a first surface 144*a* may be located on the right side 117 of the deck plate 116 and a first sensor 146*a* may extend below the first surface 144*a* on the right side 117. The first sensor 146*a* may be a pressure sensor that is configured to correspond with the cold water line 124 and the cold water flow valves 120 and 140 of the faucet 100. Similarly, a second surface 144*b* may be located on the left side 115 of the deck plate 116 and a second sensor 146*b* may extend below the second surface 144*b* on the left side 115. The second sensor 146*b* may be a pressure sensor that is configured to correspond with the hot water line 126 and the hot water flow valves 122 and 142 of the faucet 100. The sensors 146*a* and 146*b* are electronically coupled to the circuit board 152 of the electronic faucet 100 in order to transmit information to the circuit board 152 regarding the level of pressure being applied by a user to the first surface 144*a* and the second surface 144*b*, respectively. The circuit board 152 is electronically coupled to the electronic valves 140 and 142 to operate or control the rate of flow of water through the valves 140 and 142 in response to the information transmitted by the sensors 146*a* and 146*b*.

FIG. 7 illustrates a flow chart of an exemplary process performed by the electronic faucet 100 of the second embodiment to control both the rate of flow and the temperature of water flowing through the faucet 100. While FIG. 5 illustrates an embodiment of temperature and flow-rate control, it is envisioned that other methods or processes of temperature and flow-rate control can be performed by the pressure-sensing sensors and/or the circuit board of an electronic faucet 100.

As illustrated in FIG. 7, the first step 400 involves one or more sensors of the faucet detecting that a sensing portion of the faucet has been touched by a user. In particular, the sensors may include a cold-water sensor 156*a* and a hot-water sensor 156*b* that can detect pressure and transmit information to the circuit board 152. In illustrative embodiments, the cold-water sensor 156*a* is associated with the left side 117 of the deck plate 116 and the hot-water sensor 156*b* is associated with the right side 115 of the deck plate 116. In a second step 402, the circuit board determines whether the cold-water sensor 156*a* or hot-water sensor 156*b* has been triggered. The circuit board 152 will thereafter control the flow or water from the cold or hot water lines 124 and 126 via the valves 140 and 142 depending on the choice selected.

The pressure-sensing sensor 156*a* or 156*b* (possibly in conjunction with the circuit board 152) identifies whether the touch is a quick touch (e.g. a single tap) or an extended touch as a third step 404 or 405. If the touch is a quick touch, then that information is transmitted from the sensor 156*a* or 156*b* to the circuit board 152. The circuit board 152 then directs either the electronic cold water flow valve 140 and/or the electronic hot water flow valve 142, depending on which sensor 156*a* or 156*b* has been triggered, to permit flow of water at a predetermined or consistent rate of flow, as illustrated in step 408 or 409. Such "quick touch" functionality could be predetermined at a default flow rate and/or temperature to permit a user to quickly use the faucet 100 without adjusting flow rate or temperature manually.

If the touch is an extended touch, then the sensor 146*a* or 146*b* (possibly in conjunction with the circuit board 152) would collect additional information regarding the amount of pressure (e.g. light, medium or hard touch) being applied by the user against the surface 144 in a fourth step 406 or 407. The type of pressure/touch being applied is transmitted from the sensor 146*a* or 146*b* to the circuit board 152. Based on whether the sensor 156*a* or 156*b* has been triggered, the circuit board 152 then directs either the electronic cold water flow valve 140 and/or the electronic hot water flow valve 142 to permit flow of cold water or hot water (or a mixture of the two) at a rate that is dependent on the type of pressure applied. For instance, a light pressure touch could cause the valves 140 and/or 142 to open at a low flow rate as illustrated in step 410 or 411, a medium pressure touch could cause the valves 140 and/or 142 to open at a medium flow rate as illustrated in step 412 or 413, and a hard pressure touch could cause the valves 140 and/or 142 to open at a high flow rate as illustrated in step 414 or 415. Again, while this illustrative embodiment uses three different types of touch (light, medium and hard) to determine the rate of flow through a valve 140, 142, it is envisioned that any number of types of touch may be presented within the scope of the present disclosure. For instance, the sensors 156*a* and 156*b* may be able to detect and communicate hundreds of different pressure types along a gradient of pressures, and the circuit board 152 may be able to adjust the valves 140 and 142 based on changes from each gradient pressure in order to change the resulting temperature and/or rate of flow of water through the faucet 100.

In illustrative embodiments, the electronic faucet 100 may further include a temperature indicator 160 to indicate the temperature or desired temperature of the water flowing through the faucet 100, as illustrated in FIGS. 3 and 6. As an example, the temperature indicator 160 may be a visual indicator that indicates the targeted temperature sought as a user applies a touch to the pre-determined surface 144 to alter the temperature of the water flowing through the faucet 100 as described above. The temperature indicator 160 may include one or more indicator lights 162 that can transition from a color that represents a colder temperature (e.g. blue) to a color that represents a warmer temperature (e.g. red). The indicator light 162 may be able to display different gradients of color to represent different gradients of desired temperature. Alternatively, the temperature indicator 160 may be comprised of multiple indicator lights 162 in a row that work together to display a rise or fall in the desired temperature of the water. For instance, the indicator lights 162 may all provide one color (e.g. blue) when the desired water is cold, but each consecutive indicator light 162 may change to a different color (e.g. red) as the desired temperature of the water is increased by the user's touch. As another alternative, the temperature indicator 160 may indicate the actual temperature of the water for the user as opposed to the desired temperature sought by the user.

In illustrative embodiments, the temperature indicator 160 may be electronically controlled by the circuit board 152. When a sensor 146, related to temperature control, senses that a user has applied pressure to a surface 144, the circuit board 152 determines whether to open or close (partially or fully) the water valves 140 and 142 in order to produce water at a specific temperature determined by the amount of pressure being applied. The circuit board 152 can also then control the temperature indicator 160 to cause a visual display consistent with the temperature determined. Other means of controlling the temperature indicator 160 may be understood by one skilled in the art.

In some embodiments, the touch or force surface may be a multi-touch input device. Accordingly, the surface could differentiate between one, two or more fingers touching the surface. In such embodiments, the circuit board 152 could be configured, either be hardware or software programming, to control the valves 140, 142 based on the multi-touch input. For example, a touch with a single finger touch could be used to control temperature changes while a two-finger touch could be used to control flow rate (or visa versa). In some cases, a single finger touch could indicate a decrease in temperature or flow rate while a two-finger touch could indicate an increase in temperature or flow rate. Embodiments are also contemplated in which the multi-touch surface could detect gestures to control the temperature and/or flow rate.

EXAMPLES

Illustrative examples of the pressure sensitive touch electronic faucet disclosed herein are provided below. An embodiment of the pressure sensitive touch electronic faucet may include any one or more, and any combination of, the examples described below.

Example 1 is a faucet with a spout, an electronic valve assembly, a pressure sensor assembly with at least one pressure sensor, and a circuit. The electronic valve assembly includes a cold water inlet for receiving a cold water line, a hot water inlet for receiving a hot water line, and a mixed water outlet in fluid communication with the spout. The electronic valve assembly is configured to control a temperature and a flow rate of water flowing through the spout. The pressure sensor assembly is configured to detect a pressure applied to a predetermined exterior surface associated with the faucet. The circuit is electronically coupled to the pressure sensor assembly and the electronic valve assembly and is configured to adjust the electronic valve assembly based on the pressure detected by the pressure sensor assembly. The circuit is configured to differentiate between pressure readings of the pressure sensor assembly to adjust the electronic valve assembly differently with respect to flow rate and/or temperature based on different pressure readings.

In Example 2, the subject matter of Example 1 is further configured such that the circuit is configured to adjust the electronic valve assembly to increase a temperature of water flowing through the spout based on a first pressure detected by the pressure sensor assembly and decrease a temperature of water flowing through the spout based on a second pressure detected by the pressure sensor assembly, wherein the first pressure and the second pressure are different pressures.

In Example 3, the subject matter of Example 1 is further configured such that the circuit is configured to adjust the electronic valve assembly to increase a flow rate of water flowing through the spout based on a first pressure detected by the pressure sensor assembly and decrease a flow rate of water flowing through the spout based on a second pressure detected by the pressure sensor assembly, wherein the first pressure and the second pressure are different pressures.

In Example 4, the subject matter of Example 1 is further configured such that the controller is configured to dynamically adjust the electronic valve assembly with respect to temperature based on a change in pressure detected by the pressure sensor assembly.

In Example 5, the subject matter of Example 4 is further configured such that the controller is configured to adjust the electronic valve assembly to dynamically increase or decrease temperature of water flowing through the spout as pressure detected by the pressure sensor assembly increases.

In Example 6, the subject matter of Example 1 is further configured such that the controller is configured to dynamically adjust the electronic valve assembly with respect to flow rate based on a change in pressure detected by the pressure sensor assembly.

In Example 7, the subject matter of Example 6 is further configured such that the controller is configured to adjust the electronic valve assembly to dynamically increase or decrease flow rate of water flowing through the spout as pressure detected by the pressure sensor assembly increases or decreases.

In Example 8, the subject matter of Example 1 is further configured such that the predetermined exterior surface is located on an exterior surface of the faucet and/or a deck plate of the faucet.

In Example 9, the subject matter of Example 1 is further configured such that the faucet further includes a second pressure sensor configured to detect a pressure applied to a second predetermined exterior surface associated with the faucet. The circuit is configured to control operation of the electronic valve based on the pressure measured by the first pressure sensor and the second pressure sensor. The circuit is configured to control flow rate of water flowing through the spout based on the first pressure sensor and control temperature of water flowing through the spout based on the second pressure sensor.

In Example 10, the subject matter of Example 1 further comprises a manual valve that controls a flow and/or temperature of water flowing through the spout based on user-actuated movement of a faucet handle.

In Example 11, the subject matter of Example 1 further comprises an indicator that visually represents a desired temperature based on the pressure measured by the pressure sensor assembly.

Example 12 is an electronic valve assembly with an electronic valve arrangement, a pressure sensor assembly with at least one pressure sensor and a circuit electronically coupled to the pressure sensor assembly and the electronic valve arrangement. The electronic valve arrangement includes a fluid inlet and a fluid outlet. The electronic valve arrangement configured to control a temperature and/or a flow rate of fluid coming from the outlet. The pressure sensor assembly configured to detect an amount of pressure being applied to a surface. The circuit is configured to control the electronic valve arrangement to adjust a temperature and/or a flow rate of water through the outlet based on the amount of pressure detected by the pressure sensor assembly.

In Example 13, the subject matter of Example 12 is further configured such that the circuit is configured to control the electronic valve arrangement such that the amount of pressure being applied to the surface detected by the pressure sensor assembly dynamically adjusts a flow rate of fluid through the water outlet.

In Example 14, the subject matter of Example 12 is further configured such that the circuit is configured to control the electronic valve arrangement such that the amount of pressure being applied to the surface detected by the pressure sensor assembly dynamically adjusts a temperature of fluid flow through the outlet.

In Example 15, the subject matter of Example 12 is further configured such that the pressure sensor assembly includes a first pressure sensor configured to detect a pressure being applied to a first surface and a second pressure sensor configured to detect a pressure being applied to a second surface.

In Example 16, the subject matter of Example 15 is further configured such that the controller is configured to adjust a flow rate of fluid flowing through the outlet of the electronic valve arrangement based on a pressure detected by the pressure sensor assembly.

In Example 17, the subject matter of Example 15 is further configured such that the controller is configured to adjust a temperature of fluid flowing through the outlet of the electronic valve arrangement based on a pressure detected by the second pressure sensor.

Example 18 is a method of adjusting the water flowing through a faucet. The method includes the step of providing a faucet including a spout and an electronic valve assembly for controlling a flow rate and/or temperature of water flowing through the spout. A pressure sensor assembly with at least one pressure sensor is used to detect an amount of pressure being applied a surface. The flow rate and/or temperature of water flowing through the electronic valve assembly is adjusted based on the amount of pressure detected.

In Example 19, the subject matter of Example 18 is further configured to include the step of dynamically adjusting a flow rate of water through the electronic valve assembly based on a change in pressure detected by the pressure sensor assembly.

In Example 20, the subject matter of Example 18 is further configured to include the step of dynamically adjusting a temperature of water through the electronic valve assembly based on a change in pressure detected by the pressure sensor assembly.

What is claimed is:

1. A faucet comprising:

a spout;

an electronic valve assembly including a cold water inlet for receiving a cold water line, a hot water inlet for receiving a hot water line, and a mixed water outlet in fluid communication with the spout, the electronic valve assembly configured to control a temperature and a flow rate of water flowing through the spout;

a pressure sensor assembly including at least one pressure sensor configured to detect a pressure or a location of the pressure applied to a predetermined exterior surface associated with the faucet, wherein multiple locations of pressure can be detected simultaneously to allow sensing of multi-touch input; and a circuit electronically coupled to the pressure sensor assembly and the electronic valve assembly, the circuit configured to dynamically adjust the electronic valve assembly based on the pressure detected by the pressure sensor assembly;

wherein the circuit is configured to differentiate between pressure readings and the location of the pressure applied to the pressure sensor assembly to dynamically adjust the electronic valve assembly differently with respect to flow rate and/or temperature based on a change in pressure readings detected by the pressure sensor assembly.

2. The faucet of claim 1, wherein the circuit is configured to adjust the electronic valve assembly to increase a temperature of water flowing through the spout based on a first pressure detected by the pressure sensor assembly and decrease a temperature of water flowing through the spout based on a second pressure detected by the pressure sensor assembly, wherein the first pressure and the second pressure are different pressures.

3. The faucet of claim 1, wherein the circuit is configured to adjust the electronic valve assembly to increase a flow rate of water flowing through the spout based on a first pressure detected by the pressure sensor assembly and decrease a flow rate of water flowing through the spout based on a second pressure detected by the pressure sensor assembly, wherein the first pressure and the second pressure are different pressures.

4. The faucet of claim 1, wherein the circuit is configured to adjust the electronic valve assembly to dynamically increase or decrease temperature of water flowing through the spout as pressure detected by the pressure sensor assembly increases.

5. The faucet of claim 1, wherein the circuit is configured to dynamically adjust the electronic valve assembly with respect to flow rate based on a change in pressure detected by the pressure sensor assembly.

6. The faucet of claim 5, wherein the circuit is configured to adjust the electronic valve assembly to dynamically increase or decrease flow rate of water flowing through the spout as pressure detected by the pressure sensor assembly increases or decreases.

7. The faucet of claim 1, wherein the predetermined exterior surface is located on an exterior surface of the faucet and/or a deck plate of the faucet.

8. The faucet of claim 1, wherein the faucet further includes a second pressure sensor assembly configured to detect a pressure applied or the location of the pressure applied to a second predetermined exterior surface associated with the faucet, wherein the circuit is configured to control operation of the electronic valve based on the pressure measured or the location of the pressure detected by the pressure sensor assembly and the second pressure sensor assembly, wherein the circuit is configured to control flow rate of water flowing through the spout based on the pressure sensor assembly and control temperature of water flowing through the spout based on the second pressure sensor assembly.

9. The faucet of claim 1, wherein the faucet further comprises a manual valve that controls a flow and/or temperature of water flowing through the spout based on user-actuated movement of a faucet handle.

10. The faucet of claim 1, further comprising an indicator that visually represents a desired temperature based on the pressure measured by the pressure sensor.

11. An electronic valve assembly comprising:

an electronic valve arrangement including a fluid inlet and a fluid outlet, the electronic valve arrangement configured to control a temperature and/or a flow rate of fluid coming from the outlet;

a pressure sensor assembly including at least one pressure sensor configured to detect an amount of pressure or the location of the pressure being applied to a surface, wherein multiple locations of pressure can be detected simultaneously to allow sensing of multi-touch input; and a circuit electronically coupled to the pressure sensor assembly and the electronic valve arrangement, the circuit configured to control the electronic valve arrangement to dynamically adjust a temperature and/or a flow rate of water through the outlet based on a change in pressure detected or the location of the pressure detected by the pressure sensor assembly.

12. The electronic valve assembly of claim 11, wherein the circuit is configured to control the electronic valve arrangement such that the amount of pressure being applied to the surface detected by the pressure sensor assembly dynamically adjusts a flow rate of fluid through the fluid outlet.

13. The electronic valve assembly of claim 11, wherein the circuit is configured to control the electronic valve arrangement such that the amount of pressure being applied to the surface detected by the pressure sensor assembly dynamically adjusts a temperature of fluid flow through the outlet.

14. The electronic valve assembly of claim 11, wherein the pressure sensor assembly includes a first pressure sensor configured to detect a pressure being applied to a first surface and a second pressure sensor configured to detect a pressure being applied to a second surface.

15. The electronic valve assembly of claim 14, wherein the circuit is configured to adjust a flow rate of fluid flowing through the outlet of the electronic valve arrangement based on a pressure detected by the first pressure sensor.

16. The electronic valve assembly of claim 14, wherein the circuit is configured to adjust a temperature of fluid flowing through the outlet of the electronic valve arrangement based on a pressure detected by the second pressure sensor.

17. A method of adjusting water flowing through a faucet, the method comprising:

providing a faucet including a spout and an electronic valve assembly for controlling a flow rate and/or temperature of water flowing through the spout;

detecting, via a pressure sensor assembly including at least one pressure sensor, an amount of pressure being applied to a surface or a location of the pressure applied, wherein multiple locations of pressure can be detected simultaneously to allow sensing of multi-touch input; and dynamically adjusting a flow rate and/or temperature of water flowing through the electronic valve assembly based on a change in pressure detected by the pressure sensor assembly.

* * * * *